US008607611B2

(12) United States Patent
Jacquet

(10) Patent No.: US 8,607,611 B2
(45) Date of Patent: Dec. 17, 2013

(54) PRESS BRAKE FOR BENDING SHEETS

(75) Inventor: Philippe Jacquet, Luceau (FR)

(73) Assignee: Amada Co., Ltd., Kanagawa (JP)

( * ) Notice: Subject to any disclaimer, the term of this patent is extended or adjusted under 35 U.S.C. 154(b) by 411 days.

(21) Appl. No.: 12/721,987

(22) Filed: Mar. 11, 2010

(65) Prior Publication Data

US 2010/0229621 A1 Sep. 16, 2010

(30) Foreign Application Priority Data

Mar. 13, 2009 (FR) ..... 09 51613

(51) Int. Cl.
*B21D 31/00* (2006.01)

(52) U.S. Cl.
USPC ..... 72/390.4; 72/389.3; 72/390.5; 72/482.3

(58) Field of Classification Search
USPC ..... 72/386, 389.1–389.4, 390.4, 390.5, 72/481.1, 482.3; 100/257, 291
See application file for complete search history.

(56) References Cited

U.S. PATENT DOCUMENTS 4,147,102 A * 4/1979 Bigelow ..... 100/257
4,336,008 A * 6/1982 Pesch ..... 425/406
5,746,122 A * 5/1998 Gietz et al. ..... 100/43
5,878,618 A * 3/1999 Stalzer ..... 72/452.9
5,891,281 A * 4/1999 Giordano et al. ..... 156/64
6,389,940 B1 * 5/2002 Long et al. ..... 83/23
6,401,512 B1 * 6/2002 Gascoin ..... 72/389.4
2009/0126434 A1 * 5/2009 Kawasaki ..... 100/289

FOREIGN PATENT DOCUMENTS

| | | |
|---|---|---|
| EP | 1112130 | 4/2002 |
| EP | 1452302 | 9/2004 |
| JP | 2001 121214 | 5/2001 |
| WO | WO 01/43896 | 6/2001 |

OTHER PUBLICATIONS

French Preliminary Search Report corresponding to French application No. 0951609 dated Dec. 11, 2009.

* cited by examiner

*Primary Examiner* — Dana Ross
*Assistant Examiner* — Pradeep C Battula
(74) *Attorney, Agent, or Firm* — Kilpatrick Townsend & Stockton LLP

(57) ABSTRACT

The present invention relates to a press brake for bending metal sheets, said press brake having an upper and a lower table, one of which has two slots, and having at least one pair of wedges, each wedge being disposed in a respective one of the two slots; and a primary control lever that is common to the wedges of the pair of wedges and that is suitable for moving said wedges of the pair of wedges in their respective slots.

20 Claims, 4 Drawing Sheets

PRESS BRAKE FOR BENDING SHEETS

FIELD OF THE INVENTION

The present invention relates to a bending press or "press brake" having tables with controlled deformation.

BACKGROUND OF THE INVENTION

Bending presses are machine tools of a type that is itself well known. As shown in accompanying FIG. 1, the machine tool comprises a lower table 12 and an upper table 14 that is movable relative to the lower table 12. Usually, the lower table 12 is stationary and the upper table 14 is suitable for being moved towards the lower table 12 under drive from actuators $V_1$ and $V_2$ that act on the ends 14*a* and 14*b* of the upper table 14. Usually, the lower table 12 has its free edge 12*a* fitted with fastener means 16 for fastening bending matrices 18. In the same way, the edge 14*c* of the upper table 14 is fitted with fastener means 20 for fastening bending punches 22.

A metal sheet or lamination F is placed on the bending matrices 18 of the lower table 12. The sheet F may be of a length that varies widely depending on the circumstances. Under drive from the pistons of the actuators $V_1$ and $V_2$, the punches 22 mounted on the upper table move towards the metal sheet or lamination F placed on the matrices of the lower table. As soon as the punch 22 comes into contact with the sheet, force begins to increase within the sheet as the punch penetrates therein, initially in the elastic range and subsequently in the plastic range, thereby enabling the sheet to be bent permanently.

Because the force is applied to the upper table 14 by the actuators $V_1$ and $V_2$ acting on the ends of the table, the linear load distributed between the two ends of the tables corresponds to the upper table being deformed along a line in the form of a concave arc with deformation maximas close to the midplane of the table. This means that, for bending purposes, at the end of bending, the central portions of the punches 22 have penetrated into the sheet F less than have the end portions. If bending were to be performed on a matrix that, itself, were to remain perfectly straight during bending, then the result would be that a workpiece would be obtained having a bend angle that was wider in its central portion than at its ends. Such a result is naturally unacceptable.

In order to remedy that drawback, various solutions have been proposed for the purpose of controlling these deformations at the edges of the tables by using various means in order to obtain a bend that is substantially identical over the entire length of the bent workpiece.

Conventionally, these solutions involve providing slots, such as the slots 24 and 26 shown in FIG. 1, that are formed in the lower table 12 symmetrically about the midplane P'P of the press. These slots 24, 26 then define between them a central zone 30 of the lower table 12 that is slot-free and that presents a length b, each of the two slots 24 and 26 being of length a. With slots 24 and 26 of conventional type, i.e. that leave between them a slot-free portion 30 of length b, substantially parallel deformations are obtained for the edges of the upper and lower tables 14 and 12.

In addition to the difficulty of proposing a bending press that is suitable for enabling the metal lamination or sheet F for bending to be deformed substantially uniformly over the entire length of said lamination or sheet F, regardless of whether its length is short compared with the length of the tables 12, 14 of the press or, on the contrary, is equal to the length of the tables 12, 14 of the press, there exists an additional difficulty related to managing the deformation of the top edges 24", 26" of the slots 24, 26 while the bending force of the moving table 14 is being applied to the stationary table 12, and said force is being taken up on the bottom edges 24', 26' of the slots 24, 26, such management of said management being hitherto poorly mastered.

OBJECT AND SUMMARY OF THE INVENTION

An object of the present invention is to remedy these two problems by proposing to place at least one pair of wedges, each wedge of the pair being disposed in a respective one of the slots 24, 26. The invention also further comprises adjustment means that are common to both of the wedges of the pair of wedges and that are suitable for moving said wedges of the pair of wedges in their respective slots 24, 26 for adjusting as well as possible the force take-up.

The invention thus provides a press brake for bending at least one metal sheet, said press brake comprising:

an upper table having a bottom edge carrying first bending tools, and a lower table having a top edge carrying second bending tools, the two tables being movable relative to each other to exert a bending force on the sheet;

one of said tables having two slots, each slot having a first edge and a second edge, and an open first end opening out in a side edge of the table, as well as a closed end;

wherein said press brake further comprises:

at least one pair of wedges, each wedge being disposed in a respective one of the two slots; and adjustment means that are common to the wedges of the pair of wedges and that are suitable for moving said wedges of the pair of wedges in their respective slots; and the adjustment means comprise a primary control lever for moving the two wedges of the pair of wedges together, preferably by the same distance.

In embodiment, each wedge of the pair of wedges is connected to the primary control lever via at least one link.

In an embodiment, the adjustment means move the wedges of the pair of wedges in opposite directions. In these circumstances, the links that connect the two wedges of the pair of wedges respectively to the primary control lever are coupled to said lever on either side of the fulcrum of said lever.

In another embodiment of the invention, the adjustment means move the wedges of the pair of wedges in the same direction. In these circumstances, the links that connect the two wedges of the pair of wedges respectively to the primary control lever are coupled to said lever on the same side of the fulcrum of said lever.

Preferably, the press brake of the invention has at least two pairs of wedges, the two wedges of each pair of wedges being disposed in respective ones of the two slots.

In an aspect of the invention, the wedges of the two pairs of wedges are moved by the primary control lever.

In a possibility offered by the invention, in addition to the primary control lever suitable for moving the wedges of the first pair of wedges, said press brake has a secondary control lever suitable for moving the wedges of a second pair of wedges. In this embodiment, the secondary control lever is advantageously associated with the primary control lever so that the position of the secondary control lever is adjustable relative to the position of the primary control lever and so that, by actuating the primary control lever, the wedges of the first and second pairs of wedges can be moved together.

In a particularly advantageous aspect of the invention, the adjustment means are suitable for moving the first pair of wedges by a first distance and the second pair of wedges by a second distance, the first and the second distances being proportional to each other.

Advantageously, the primary control lever and the secondary control lever are mounted to pivot about a common fulcrum.

In an advantageous aspect of the invention, each wedge of said at least one pair of wedges co-operates with a stationary second wedge to form a stopper set.

In these circumstances, each wedge of said at least one pair of wedges advantageously has a first end secured to the first slot edge and a second end forming a contact surface for coming into contact with the wedge with which it forms a stopper set.

In an advantageous aspect of the invention, at least in the zone of the wedges, the slots have a constant height so that the first edge and the second edge are parallel, in the absence of bending force for bending the metal sheet.

Advantageously, the contact surface of at least one of the wedges of each stopper set is inclined at a slope lying in the range 1% to 40% and preferably in the range 5% to 10%, relative to the parallel edges of the slots.

In an embodiment, the press brake has a vertical midplane P'P, the two slots being disposed symmetrically about said midplane. Preferably, the two slots extend through the entire thickness of the table.

BRIEF DESCRIPTION OF THE DRAWINGS

Other characteristics and advantages of the invention appear more clearly on reading the following description of preferred embodiments of the invention given by way of non-limiting example. The description refers to the accompanying drawings, in which.

MORE DETAILED DESCRIPTION

Figure 3:
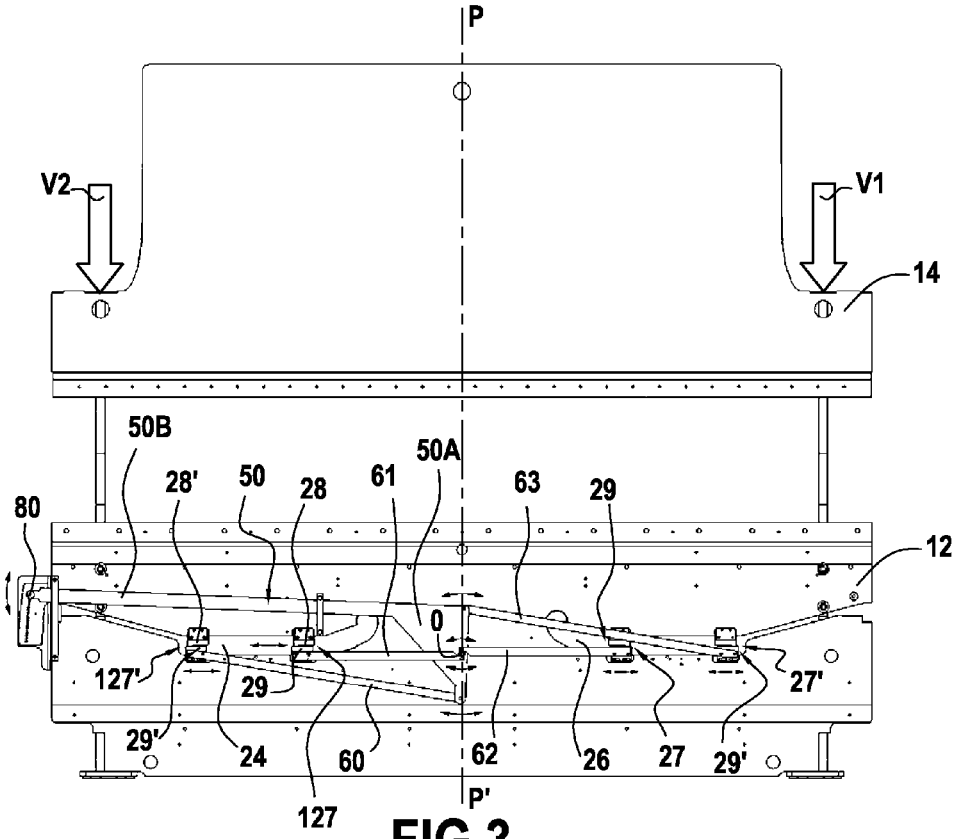
FIG. 3 is an overall diagrammatic view of a first embodiment of a press brake of the invention.

As shown in FIG. 3, the expression "pair of wedges" 29 is used to mean a wedge 29 situated in the slot 24 and a wedge 29 situated in the slot 26. In this example, a second pair of wedges 29' is also provided, with a wedge 29' in the slot 24 and a wedge 29' in the slot 26. The wedges 29 are situated closer to the central portion 30 than are the wedges 29'. In this example, each wedge 29 or 29' is associated with another wedge 28 or 28'.

Figure 1:
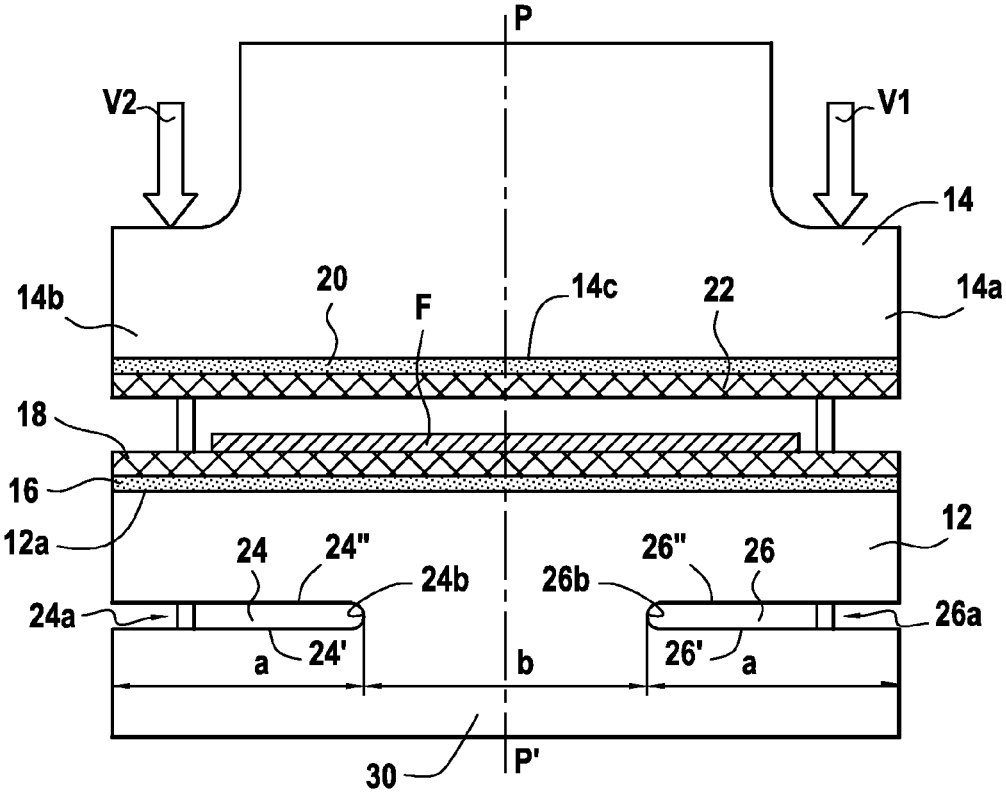
FIG. 1 shows a press brake having two slots situated on respective sides of the midplane P'P and extending from opposite sides of the lower table.
Figure 2:
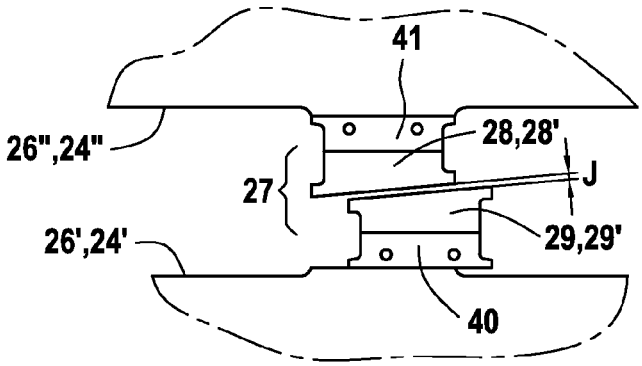
FIG. 2 is a diagrammatic view showing an embodiment of a stopper set that is made up of two wedges, one of the wedges being connected to the top edge of a slot, and the other being connected to the bottom edge of the slot.

FIG. 2 is a section view of two wedges 28, 29 of a stopper 27 of the invention. Each of the two wedges 28, 29 has a respective contact first surface facing the contact first surface of the other wedge 28', 29'. Prior to application of a bending force $F_0$, clearance j separates these respective surfaces. The wedges 28, 29 shown in FIG. 2 are shown to illustrate an example of wedges that may be used in the invention, but the invention is not limited to this type of wedge.

Each of the wedges 28, 28', 29, 29' is mounted on a respective support 40, 41 connected to a respective edge 24', 26' or 24", 26" of a respective one of the slots 24 and 26. The function of each wedge 28, 28', 29, 29'/stopper 27 is to control the extent to which the edges 24', 24" and 26', 26" of each slot 24, 26 move towards each other when the bending force is applied. By controlling the extent to which the edges 24', 24" and 26', 26" of the slot 24 or 26 move towards each other, it is possible to control the deformation of the top edge 24", 26" of the slot 24, 26, and therefore the deformation of the top edge 12*a* of the lower table 12.

At least one of the supports 40 or 41, and optionally both of the supports 40 and 41 is/are mounted to move laterally, i.e. along an axis parallel to the parallel edges 24', 26' and 24", 26" of the slots 24, 26 on which it is mounted.

In the examples chosen to illustrate the invention in the accompanying figures, only the supports 40 are suitable for being moved by adjustment means of the invention, but naturally the supports 41 of the wedges 28 or 28' could also be movable. It should however be noted that it is the relative positioning of the two wedges 28, 29, or 28', 29' that belong to the same stopper, and thus that are designed to come into contact with each other, that is important, so that by moving only one of them 28, 28' or 29, 29', relative adjustment of the position of the wedges 28, 29 or 28', 29' is obtained so that the forces are taken up well from one wedge to the other. The relative position of two wedges 28, 29 or 28', 29' that are designed to come into contact with each other can be adjusted by the adjustment means of the invention to within one hundredth of a millimeter for the wedges of as many pairs of wedges as desired.

A first object of the invention lies in moving the two wedges of a pair of wedges 29, 29' symmetrically, i.e. so that moving one wedge of the pair of wedges 29, 29' towards or away from the midplane P'P results in the other wedge of the pair of wedges 29 or 29' being moved towards or away from said midplane in exactly identical manner. Such an object is achieved by the embodiment shown in FIGS. 3 and 4.

Figure 4:
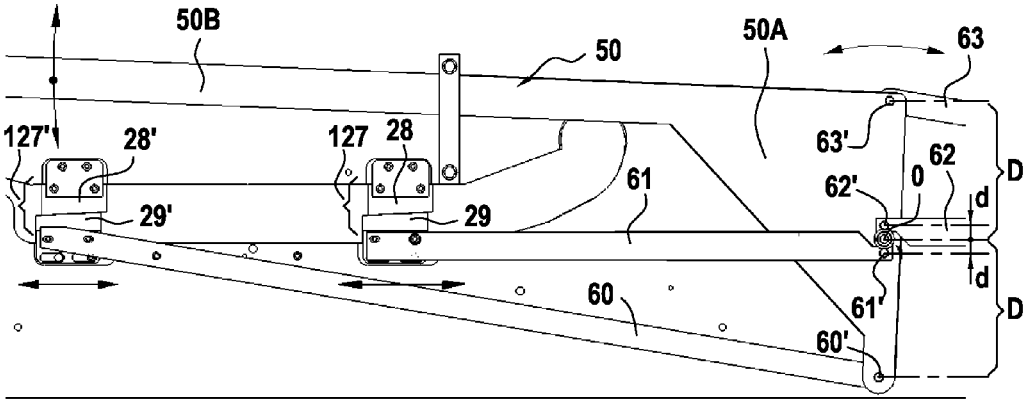
FIG. 4 is an enlarged view of another portion of the press brake of FIG. 3.

In FIGS. 3 and 4, the common adjustment means for moving the wedges of a pair of wedges 29 or 29' consists of a primary control lever 50. Said primary control lever 50 comprises a lever head 50A mounted to pivot about the axis O and an actuation arm 50B. This fulcrum O is situated on the lower table 12, advantageously on the middle axis P'P. This primary control lever 50 is actuatable via the end 80 of the actuation arm 50B that is provided with a handle adapted to being taken hold of by an operator. In addition, each wedge of the two pairs of wedges 29 and 29' is connected to said primary control lever 50 via a respective link 60, 61, 62, and 63.

The links 61 and 62 that are of the same length connect the wedges of the pair of wedges 29 that is situated closest to the midplane P'P to the primary control lever 50. Each of the two links 61, 62 has an end fastened to one of the wedges 29 and its other end 61', 62' fastened to the lever head 50A in the vicinity of the pivot axis O. The distance between each end 61', 62' of the links 61 and 62 and the axis O is equal to the same relatively short distance d, e.g. equal to 5 millimeters (mm). In this example, the ends 61' and 62' are fastened to the lever head 50A on either side of the axis O, symmetrically thereabout, and the ends 61', 62' and the fulcrum O are aligned.

In the same way, each of the links 60 and 63, of the same length, has one end fastened to one of the wedges 29' and another end 60', 63' fastened to the head 50A of the primary control lever 50 at the same distance D from the pivot axis O, e.g. equal to 40 mm. The two ends 60' and 63' of the two links 60, 63 are, like the ends 61', 62' of the links 61, 62, situated on either side of the pivot axis O, and the ends 60', 63' and the axis O are aligned.

When the primary control lever 50 is actuated so that its lever head 50A is pivoted through a certain angle, it pivots the respective ends 60', 63', and 61', 62' of the links 60, 63 and 61, 62 so that the links 61 and 62 move each wedge of the pair of wedges 29 by the same first distance, while the links 60, 63 move each wedge of the pair of wedges 29' by a second distance. The ratio k of the second distance to the first distance is equal to the ratio of the distances D to d. The invention thus makes it possible to adjust the relative position of the wedges of the two pairs of wedges 29 and 29' in proportional manner.

In this embodiment, the movement of the links 61, 62, and 60, 63 is a movement that moves the two wedges of each of the pairs of wedges 29 or 29' towards or away from the midplane P'P due to the fact that the links 61, 62 and 60, 63 are mounted respectively in pairs with, for each link of a pair 61, 62 or 60, 63, their respective ends 61', 62' and 60', 63' situated on either side of the pivot axis O. In the embodiment shown in FIGS. 3 and 4, the movements of the wedges of each of the pairs of wedges 29 and 29' are symmetrical movements so that the wedges of a pair of wedges 29 or 29' maintain the symmetry of their positions relative to the midplane P'P.

When the ends 61', 62' of the two links 61, 62 are situated respectively on the same side of the pivot axis O, the wedges of the pair of wedges 29 are moved in the same direction so that if one of the wedges of the pair of wedges 29 moves away from the midplane P'P, the other wedge of the pair of wedges 29 moves towards the midplane P'P. Naturally, the ends 60', 63' of the two links 60, 63 being disposed in the same way on the same side of the pivot axis O has the same effect on the movement of each wedge of the pair of wedges 29'. In this embodiment (not shown in the accompanying figures), the movements of each of the pairs of wedges 29 and 29' are movements that are not symmetrical about the midplane P'P.

Figure 5:
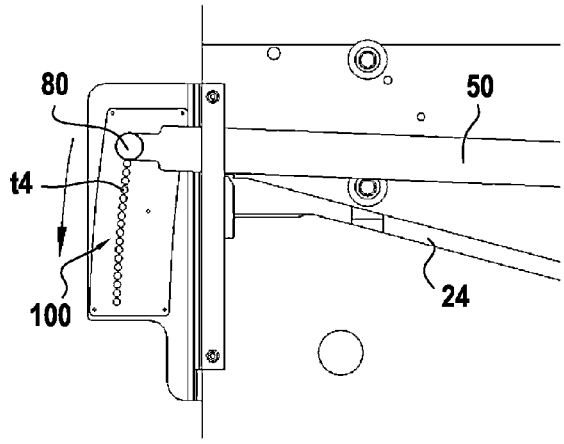
FIG. 5 is an enlarged view of another portion of the press brake of FIG. 3.

Advantageously, the position of the primary control lever 50 is indexable. FIG. 5 shows how such indexing can be obtained. Thus, FIG. 5 shows in detailed manner the actuation end 80 of the primary control lever 50. This end 80 of the primary control lever 50 is provided with a handle having a rod suitable for being inserted into a plurality of indexing holes 100 so that, once the primary control lever 50 has been moved, said lever is retained in the desired position; each of the indexing holes 100 defines a pivot angle for the primary control lever 50 and thus, a degree of actuation for said lever. The end 80 of the primary control lever 50 is suitable for being manipulated by an operator or optionally by an automated system that is suitable for pivoting the primary control lever 50.

Figure 8:
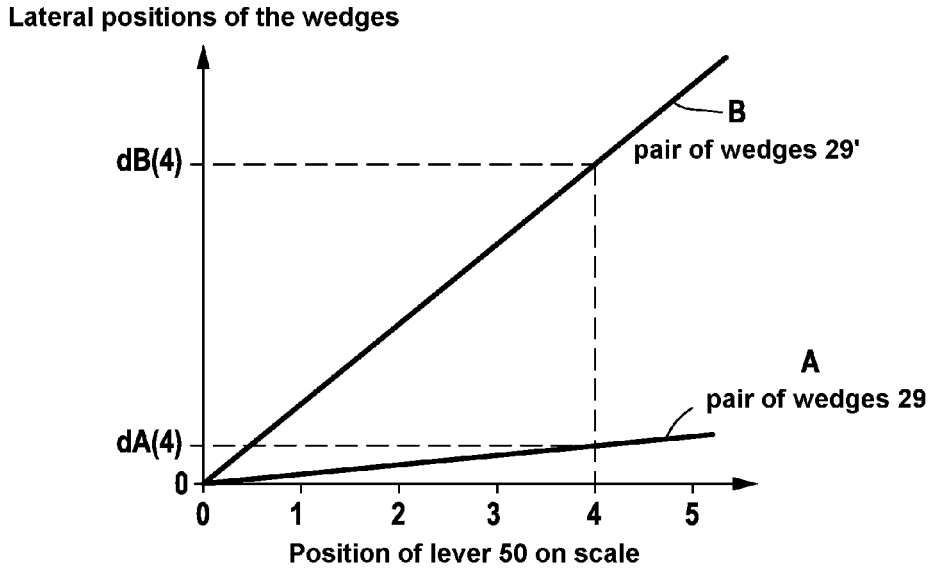
FIG. 8 is a graph showing the lateral positions of the two pairs of stoppers as a function of the position of the primary control lever corresponding to the first embodiment shown in FIGS. 3 to 5.

FIG. 8 shows the relationship between the position of the primary control lever 50 and the movement of the wedges of each of the pairs of wedges 29 and 29'. In this figure, it can also be noted that if the primary control lever 50 has been moved from the initial position (position 0 corresponding to the position shown in FIG. 5) to the position 4, e.g. the fourth indexing hole t4 (see FIG. 5), the wedges of the pair of wedges 29 have been moved by a distance dA while the wedges of the pair of wedges 29' have been moved by a distance dB; since the movements of the pairs of wedges 29 and 29' are always proportional, in a ratio k=D/d (see FIG. 4), the relationship dB=k×dA is obtained. By way of example, assuming that the ratio k is equal to 8 (d=5 mm, D=40 mm), movement by 0.4 mm of the wedges of the pair of wedges 29 corresponds to movement by 3.2 mm of the wedges of the pair of wedges 29'.

Figure 6:
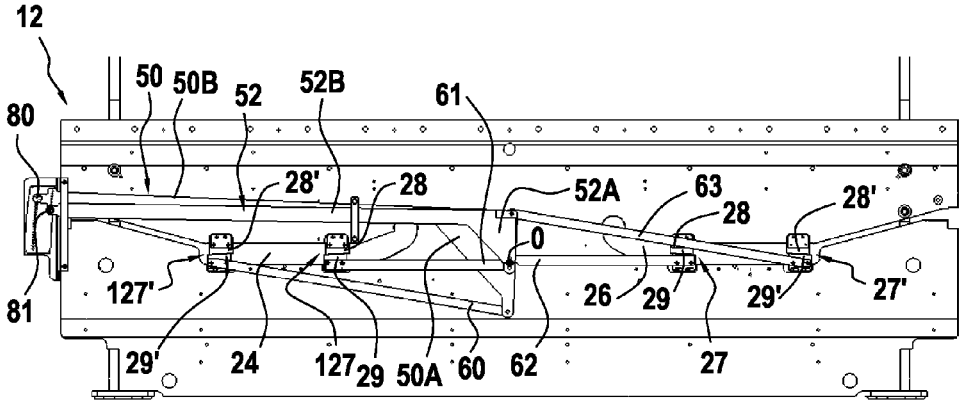
FIG. 6 is a fragmentary view of the second embodiment of the press brake of the invention.
Figure 7:
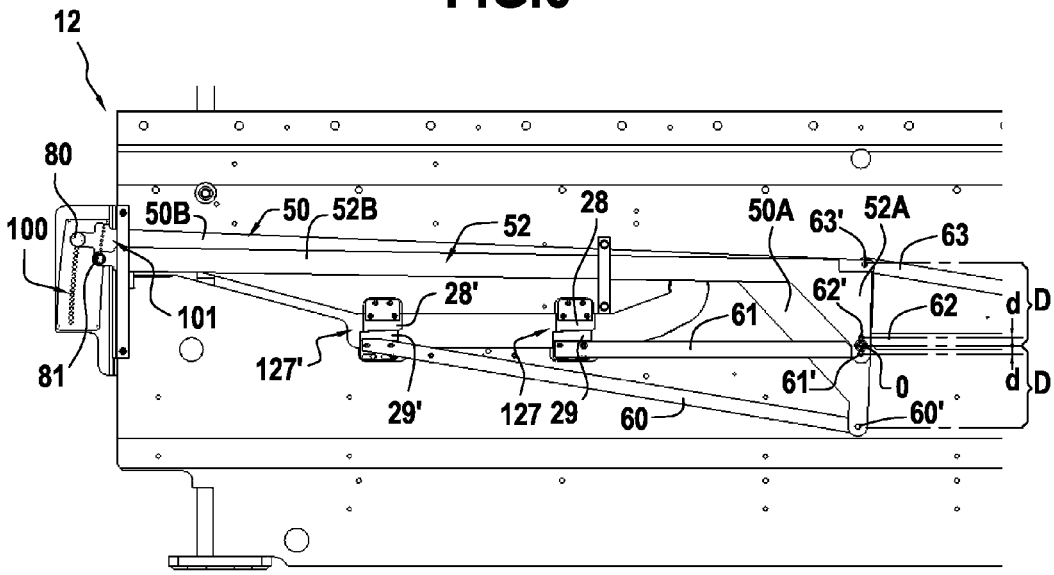
FIG. 7 is an enlarged view of a portion of the press brake of FIG. 6.

In the embodiment shown in FIGS. 6 and 7, the brake press of the invention has a secondary control lever 52 in addition to the primary control lever 50. Like the primary control lever 50, the secondary control lever 52 comprises a lever head 52A mounted to pivot about the pivot axis O, and an actuation arm 52B. The secondary control lever 52 is pivoted at one of its ends about the pivot axis O of the primary control lever 50 while its other end 81 is fastened to the primary control lever 50. Thus, the pivot axis O is common to the two levers 50 and 52. The links 60 and 63 of the wedges of the pair of wedges 29' are fastened to the primary control lever 50 in a manner identical to the manner in which they are fastened in the embodiments of FIGS. 3 and 4 (distance D between their ends 60', 63' and the pivot axis O). Conversely, the links 61 and 62 are fastened, via their ends 61', 62', to the head 52A of the secondary control lever 52 at the distance d from the pivot axis O. The lever 52 is inclinable relative to the lever 50 in such a manner as to vary the projection of the distance d onto an axis A defined by the alignment of the pivot axis O and of the ends 60' and 63'. The secondary control lever 52 can be retained in the chosen inclination relative to the lever 50 so that actuating the lever 50 moves both of the wedges 29 and 29'. The position of the lever 52 is indexable relative to the primary control lever 50 by a system (indexing holes 101) analogous to the above-described indexing system 100 of the primary control lever 50. Thus, the secondary control lever 52 is pivoted in the same manner as the primary control lever 50, by the rods of the handles situated at the ends 80, 81 being caused to go respectively from one indexing hole to another in the series of indexing holes 100, 101. It can thus be understood that moving the primary control lever 50 causes the secondary control lever 52 to move and thus all of the links 60, 61, 62, and 63 to move, while moving the secondary control lever 52 on its own causes only the links 61 and 62 to move.

Figure 9:
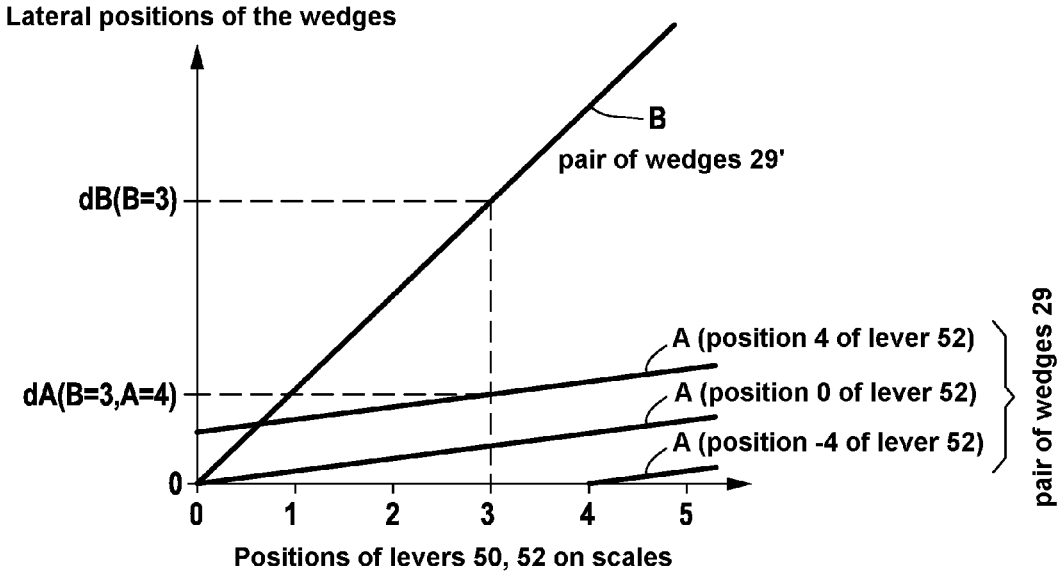
FIG. 9 is a graph showing the lateral positions of the two pairs of stoppers as a function of the two control levers, namely the primary and the secondary control levers, corresponding to the second embodiment shown in FIGS. 6 and 7.

It should be noted that, in the example chosen to illustrate the invention, there exist nine indexing holes for moving the secondary control lever 52 relative to the primary control lever 50 (from the position "4" to the position "−4", via the position 0 at which the two levers 50 and 52 coincide), as indicated in FIG. 9 with reference to this embodiment.

As shown in FIG. 9, the actuation arms 50B, 52B of the levers 50, 52 may be aligned (position 0 of the secondary control lever 52; central case A in FIG. 9), and, in these circumstances, the situation is that of the single primary control lever 50 of FIGS. 3 to 5, with the pairs of wedges 29 and 29' being moved laterally in a manner identical to the manner shown in FIG. 8. Conversely, by means of the secondary control lever 52, it is possible to choose to move exclusively the wedges of the pair of wedges 29. Thus, in addition to showing the position 0 in which the two actuation arms 50B and 52B are aligned, FIG. 9 shows the two extreme positions of the control lever 52 relative to the primary control lever 50, namely respectively the position "4" and the position "−4". The possibility of moving the secondary control lever 52 relative to the primary control lever 50 makes it possible to cause the proportionality ratio to be varied between the movements of the wedges 29 and movements of the wedges 29'.

In this second embodiment, the primary control lever 50 is moved from its initial position (position 0) to its position "3", thereby causing a respective proportional movement k of each of the wedges of the two pairs of wedges 29 and 29'. Then, the operator or the automated system has the possibility of moving only those wedges of the pair of wedges 29 that are situated closest to the midplane P'P, e.g. by causing the handle of the end 81 of the secondary control lever 52 to go from the position "4" to the position "−4" (i.e. from one extreme position to the other) so that, finally, after the two levers 50 and 52 have been moved, the proportional movement between the wedges of the two pairs of wedges 29 and 29' is no longer equal to said ratio k but rather to a ratio (k+γ), where γ is a function of the movement of the secondary control lever 52 that is suitable for moving only the wedges of the pair of wedges 29.

It should be noted that it is also possible, within the ambit of the present invention, for the control levers 50 and 52 to be independent from each other. In such an embodiment (not shown in the accompanying figures), the primary control lever 50 may for example pivot the links 60, 63 only, while the secondary control lever 52 pivots the links 61, 62.

Even though the invention is illustrated with two pairs of wedges, one wedge of each of the pairs 29, 29' being disposed in each of the slots 24, 26, the invention is applicable regardless of the number of wedges of pairs of wedges disposed in each of the slots 24, 26.

What is claimed is:

1. A press brake for bending at least one metal sheet, said press brake comprising:

an upper table having a bottom edge carrying first bending tools, and a lower table having a top edge carrying second bending tools, the two tables being movable relative to each other to exert a bending force on the sheet;

one of said tables having two slots, each slot having a first edge and a second edge, and an open first end opening out in a side edge of the table, as well as a closed end;

at least one pair of wedges, each wedge being disposed in a respective one of the two slots; so as to be movable in said slot;

a pivot situated on the lower table;

a primary control lever having a lever head mounted to the pivot; and a link having an end fastened to one of the wedges and its other end fastened to the lever head in the vicinity of the pivot so that actuation of said primary control lever causes the pair of wedges to move in concert, in their respective slots.

2. A press brake according to claim 1, wherein activation of the primary control lever said wedges to move by the same distance.

3. A press brake according to claim 1, wherein each wedge of the pair of wedges is connected to the primary control lever via at least one link.

4. A press brake according to claim 3, wherein the links that connect the two wedges of the pair of wedges respectively to the primary control lever are coupled to said lever on either side of a fulcrum of said lever, so that activation of said lever causes said wedges of the pair of wedges to move in opposite directions.

5. A press brake according to claim 3, wherein the links that connect the two wedges of the pair of wedges respectively to the primary control lever are coupled to said lever on the same side of the fulcrum of said lever, so that activation of said lever causes said wedges of the pair of wedges to move in opposite directions.

6. A press brake according to claim 1, wherein activation of said primary control lever said wedges of the pair of wedges to move in opposite directions.

7. A press brake according to claim 1, wherein activation of said primary control lever causes said wedges of the pair of wedges to move in the same direction.

8. A press brake according to claim 1, having at least a first and a second pair of wedges, the two wedges of each pair of wedges being disposed in respective ones of the two slots.

9. A press brake according to claim 8, wherein the wedges of the two pairs of wedges are moved by the primary control lever.

10. A press brake according to claim 8, having a secondary control lever suitable for moving the wedges of the second pair of wedges.

11. A press brake according to claim 10, wherein the secondary control lever is associated with the primary control lever so that a position of the secondary control lever is adjustable relative to a position of the primary control lever and so that, by activating the primary control lever, the wedges of the first and second pairs of wedges can be moved together.

12. A press brake according to claim 10, wherein the primary control lever and the secondary control lever are mounted to pivot about a common fulcrum.

13. A press brake according to claim 8, wherein the wedges of the first and second pairs can be moved together, whereby, when the wedges of the first pair of wedges are moved by a first distance, and the wedge of the second pair of wedges are moved by a second distance, the first and the second distances being proportional to each other.

14. A press brake according to claim 1, wherein each wedge of said at least one pair of wedges co-operates with a stationary second wedge to form a stopper set.

15. A press brake according to claim 14, wherein each wedge of said at least one pair of wedges has a first end secured to the first slot edge and a second end forming a contact surface for coming into contact with the stationary wedge with which said wedge of said at least one pair of wedges forms a stopper set.

16. A press brake according to claim 15, wherein the contact surface of at least one of the wedges of each stopper set is inclined at a slope lying in the range 1% to 40% and preferably in the range 5% to 10%, relative to the parallel edges of the slots.

17. A press brake according to claim 16, wherein the contact surface of at least one of the wedges of each stopper set is inclined at a slope lying with range of 5% to 10%, relative to the parallel edges of the slots.

18. A press brake according to claim 1, wherein at least in the zone of the wedges, the slots have a constant height so that the first edge and the second edge are parallel, in the absence of bending force for bending the metal sheet.

19. A press brake according to claim 1, having a vertical midplane, the two slots being disposed symmetrically about said midplane.

20. A press brake according to claim 1, wherein the two slots extend through the entire thickness of the table provided with said slots.

* * * * *